US006648605B2

(12) United States Patent
Nelson

(10) Patent No.: US 6,648,605 B2
(45) Date of Patent: Nov. 18, 2003

(54) PUMP UTILIZING DISSIMILAR MATERIALS TO COMPENSATE FOR TEMPERATURE CHANGE

(75) Inventor: Bryan E. Nelson, Lacon, IL (US)

(73) Assignee: Caterpillar Inc, Peoria, IL (US)

( * ) Notice: Subject to any disclaimer, the term of this patent is extended or adjusted under 35 U.S.C. 154(b) by 62 days.

(21) Appl. No.: 09/974,289

(22) Filed: Oct. 10, 2001

(65) Prior Publication Data

US 2003/0068243 A1 Apr. 10, 2003

(51) Int. Cl.[7] ..... F04B 1/12

(52) U.S. Cl. ..... 417/53; 417/212; 417/269; 91/499; 92/171.1

(58) Field of Search ..... 417/212, 269, 417/493, 494, 499, 524, DIG. 1; 92/171.1; 91/499

(56) References Cited

U.S. PATENT DOCUMENTS 2,393,544 A * 1/1946 Lum ..... 417/269
3,236,189 A * 2/1966 Pasker ..... 417/494
5,581,881 A * 12/1996 Sherman et al. ..... 91/499
5,603,609 A * 2/1997 Kadlicko ..... 417/494
6,035,828 A 3/2000 Anderson et al. ..... 417/269
6,171,070 B1 * 1/2001 Mitake ..... 417/273
6,260,471 B1 * 7/2001 Tanaka et al. ..... 92/169.1

FOREIGN PATENT DOCUMENTS

JP 58172478 A * 10/1983 ..... 417/269
JP 11353616 A * 12/1999
JP 2001-165076 * 12/1999

* cited by examiner

*Primary Examiner*—Cheryl J. Tyler
(74) *Attorney, Agent, or Firm*—Liell & McNeil

(57) ABSTRACT

A pump includes a pump housing that defines an inlet and an outlet. Within the pump housing, there is a barrel that is adjacent to at least one reciprocating piston. A sleeve surrounds the annular outer surface of the piston and is movable. The temperature change within the pump is compensated for by making at least one of the sleeve and the barrel of a material with a lower coefficient of thermal expansion than the material of the piston. A clearance defined by an inner surface of the sleeve and the annular outer surface of the piston increases when the temperature is low and decreases when the temperature is high.

19 Claims, 2 Drawing Sheets

PUMP UTILIZING DISSIMILAR MATERIALS TO COMPENSATE FOR TEMPERATURE CHANGE

TECHNICAL FIELD

This invention relates generally to variable delivery pumps within hydraulically-actuated systems, and more particularly to a method and structure for compensating for temperature changes in such pumps.

BACKGROUND

In several diesel engines today, variable delivery fixed displacement pumps supply pressurized actuation fluid to hydraulically activated systems within the engine. In one example high pressure common rail supplies pressurized lubricating oil to a plurality of hydraulically-actuated fuel injectors mounted in a diesel engine. The common rail is pressurized by a swash plate type pump that is driven directly by the engine. The rotation of the swash plate causes a plurality of parallel pistons to reciprocate up and down. The desired rail pressure is controlled at least partially as a function of the engine's operating condition. At high speeds and loads, the rail pressure is generally desired to be significantly higher than the desired rail pressure when the engine is operating at an idle condition.

There are varying methods that pumps control the pressure within the common rail. For instance, variable delivery fixed displacement pumps such as shown in U.S. Pat. No. 6,035,828 issued to Anderson et. al on Mar. 14, 2000, control the pressure within the common rail by controlling the positioning of individual sleeves that are mounted to move on the outer surface of the individual pistons within the pump. When the engine requires a maximum amount of rail pressure, the individual sleeves are positioned such that they block fluid communication between a low pressure area and spill ports defined by the individual pistons. Thus, the fluid within the pumping chambers of the pistons is pressurized and displaced to the common rail. On the other hand, when the engine does not require high rail pressure, the individual sleeves are positioned such that the spill ports are in fluid communication with the low pressure area. Thus, virtually all of the fluid is displaced to the low pressure area rather than being pressurized within the pumping chamber. The individual sleeves can be positioned at different points along the outer surface of the respective pistons in order to achieve a desired output between maximum and minimum outputs, and hence a desired rail pressure.

While variable delivery fixed displacement pumps controlling rail pressure through the positioning of sleeves have performed well, there is room for improvement. For instance, at lower temperatures, the viscosity of the oil increases, requiring increased force to move the sleeve. This reduces the actuator response of the individual sleeves and may result in long cranking cycles or the inability to start the vehicle or machinery. Engineers have address this problem by widening the clearance between the individual sleeves and the pistons in order to reduce the oil sheared between the piston and the individual sleeve while the parts more relative to one another. By widening the clearance, less force is required to move the sleeve and actuator response increases. On the other hand, at higher temperatures, the viscosity of the oil decreases, requiring less force to move the individual sleeves. If the clearance between the individual sleeve and the piston is too wide, there is increased leakage of oil through the clearance into the low pressure area, which also may result in decreasing pump efficiency. Thus, engineers have been forced to design the sleeves such that the clearance between the sleeves and the pistons is a compromise that allows acceptable performance between high and low temperatures, but no exceptional performance at any temperature.

The present invention is directed to one or more of the problems set forth above.

SUMMARY OF THE INVENTION

In one aspect of the present invention, a pump includes a pump housing defining an inlet and an outlet and in which a barrel is at least partially positioned. At least one piston reciprocates in the pump housing and is at least partially positioned in the barrel. A moveable sleeve surrounds an annular outer surface of each piston. At least one of the sleeve and the barrel is made of a material with a lower coefficient of thermal expansion than the material out of which the piston is made.

In another aspect of the present invention, there is a method of compensating for temperature change within a pump. When the temperature within the pump is low, the clearance between an annular outer surface of a piston and at least one of an inner surface of a sleeve and a barrel is increased. When the temperature within the pump is high, the clearance between the annular outer surface of the piston and at least one of the inner surface of the sleeve and the barrel is decreased.

DETAILED DESCRIPTION

Figure 1:
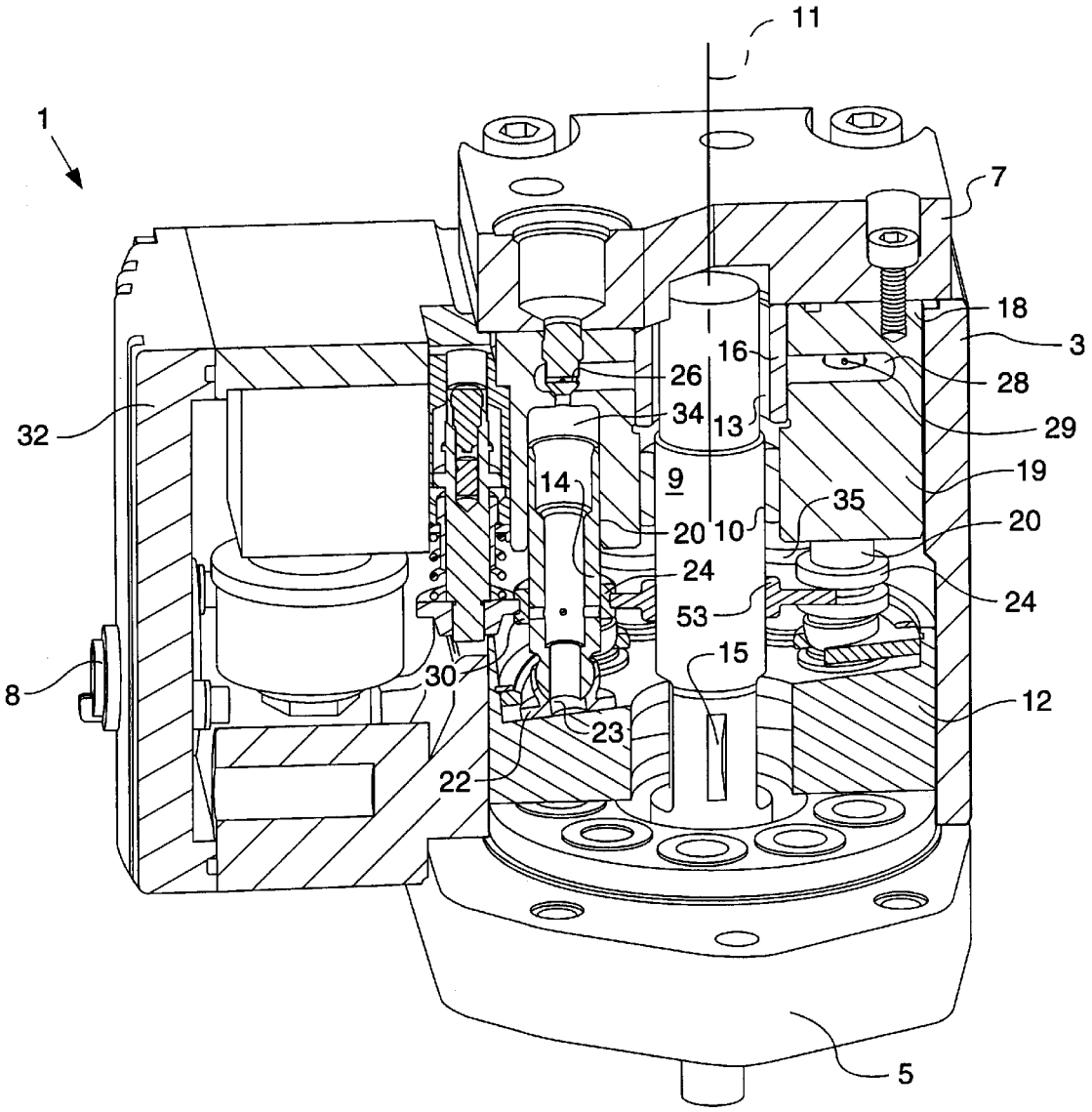
FIG. 1 is a combination perspective and cross-sectional diagrammatic view of a variable delivery fixed displacement pump according to the present invention.

Referring now to FIG. 1, there is shown a variable delivery fixed displacement pump 1 according to the present invention. Although the present invention is illustrated for a variable delivery fixed displacement pump 1, it should be appreciated that the present invention could apply to any pump utilizing a reciprocating piston within a barrel. Pump 1 includes a housing 3 that is positioned between a front flange 5 and an end cap 7. Housing 3 defines an inlet 8 and at least one high pressure outlet 29. The inlet 8 is fluidly connected to a low pressure area 35. A drive shaft 9, driven by an engine (not shown), extends into pump 1 and is supported by a bearing collar 10. Alternately, drive shaft 9 could be supported by a needle that extends into a central shaft bore 13. As illustrated, drive shaft 9 is preferably connected with a wobble plate type drive plate 12 in a keyway drive configuration in which a key fits into a drive shaft slot 15 and a drive plate slot in drive plate 12. While a keyway drive configuration that allows drive plate 12 to rotate in a non-rigid manner is preferred, it should be appreciated that other configurations are possible.

A barrel assembly 18 consisting of a barrel 19 and a pressure sealing collar 16 is bolted to the end cap 7 and defines the central shaft bore 13 having a centerline 11. The barrel 19 is at least partially positioned in the pump housing 3 and preferably defines a plurality of parallel piston bores 25, which surround the central shaft bore 13 and open into a high pressure area 28, preferably a ring shaped collector cavity. The high pressure area 28 is preferably closed from central shaft bore 13 by a pressure sealing collar 16. The barrel 19 and the collar 16 are preferably composed of identical materials so that the barrel 19 and the collar 16 have the same thermal expansion when they are heated during manufacturing of the barrel assembly 18. However, it should be appreciated that the barrel 19 and the collar 16 could be made from different materials, so long as the materials utilized have suitable coefficients of thermal expansion. For instance, because the collar 16 is placed into the barrel 19 prior to heating, collar 16 could have a coefficient of thermal expansion that is equal to or greater than that of barrel 19. Thus, during heat treatment, collar 16 could expand more than barrel 19. However, it should be appreciated that the reverse, barrel 19 expanding more than collar 16, would not be desirable. In the preferred embodiment of the present invention, the barrel 19 and the bearing collar 16 are comprised of identical substantially homogeneous metallic alloys, such as rod stock or process steel. It should be appreciated that the barrel assembly 18 could be machined from a material other than a substantially homogeneous metallic alloy. For instance, in the alternative embodiment of the present invention, the barrel 19 is comprised of ceramic, which has a lower coefficient of thermal expansion than steel and can be subjected to high pressures and harsh debris with minimal wear on the barrel 19. Barrel 19 could also be machined from a casting.

At least one piston 20 is positioned adjacent to the barrel 19 and is slideably received within the respective piston bore 14, such that it can reciprocate between an advanced and retracted position. Although the present invention will be described for one piston 20, it should be appreciated that there are preferably a plurality of pistons 20 positioned within the barrel assembly 18 that are arranged around the centerline 11 and are oriented parallel to the centerline 11. It should be appreciated that any number of pistons 20 may be used within the pump 1, and the present invention operates in the same manner for each piston 20. The piston 20 is connected to a respective piston shoe 22 by means of a flexible joint, a ball joint 23 for example, so that the piston shoe 22 can conform to the slanted drive surface of the drive plate 12 as it rotates. The rotation of the drive plate 12 causes the piston 20 to reciprocate between the advanced and retracted positions. The piston 20 defines a pumping chamber 34 in which the low pressure hydraulic fluid can be pressurized by the reciprocating piston 20. A one way outlet check valve 26 is positioned on a top end of the piston 20 to allow pressurized hydraulic fluid to flow into the high pressure area 28 for output from pump 1 and to a common rail via one or more of the high pressure outlets 29. The piston 20 is slideably positioned within a sleeve 24 that is attached to a connector 53. At least one spill port 30 is defined by each piston 20 to be in close proximity to the respective sleeve 24. Spill port 30 is a portion of an internal passage 42 that opens through the side surface of the piston 20.

The pump 1 is considered a variable delivery pump because the amount of high pressure hydraulic fluid supplied to the common rail of the hydraulic system via the outlet passages 29 varies on the positioning of the respective sleeves 24 surrounding an annular outer surface 21 of each piston 20. An electro-hydraulic control unit 32 controls the vertical position of the sleeve 24 about its respective piston 20. The electro-hydraulic control until 32 controls the discharge of pump 1 by selectively allowing the sleeve 24 to cover or uncover spill ports 30 during a variable portion of piston 20 is compression stroke. Although the electro-hydraulic control unit 32 is used to control the positioning of the sleeve 24, it should be appreciated that other types of actuators could be used to control the positioning of the sleeve 24.

Figure 2A:
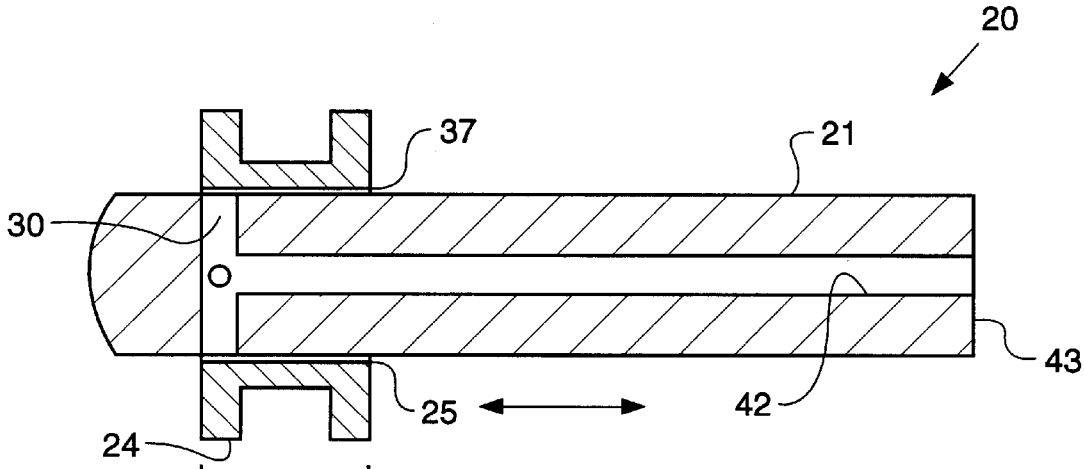
FIGS. 2*a* and 2*b* are schematic illustrations of the sleeve metering control feature for the variable delivery fixed displacement pump of FIG. 1 according to the present invention.
Figure 2B:
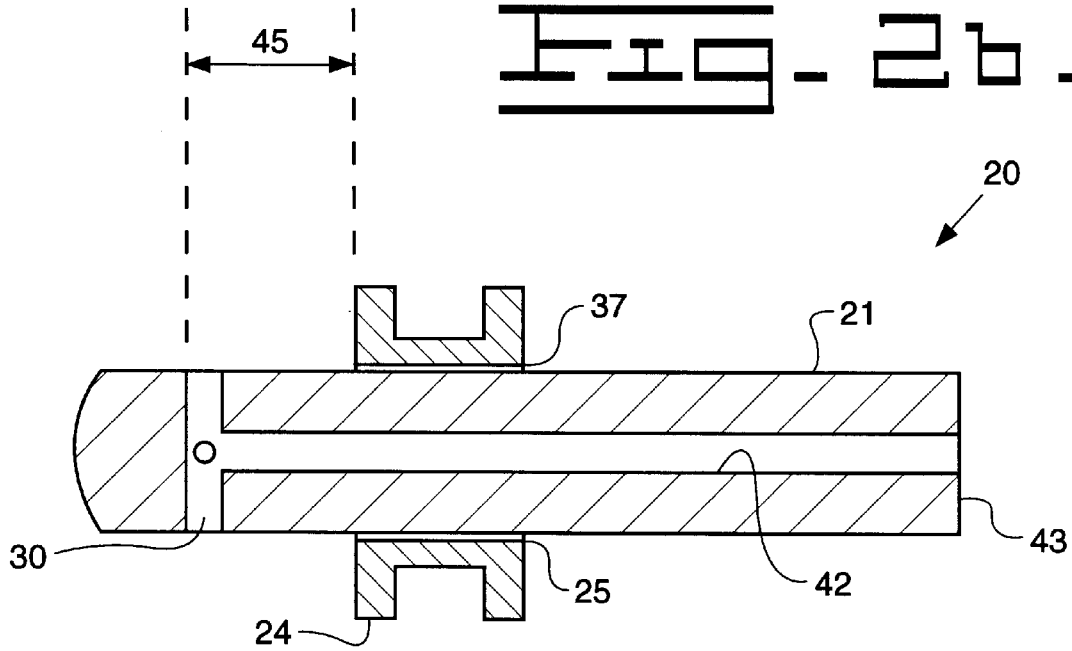

Referring now to FIGS. 2*a* and 2*b,* there are shown schematic illustrations of the sleeve metered control system for the pump 1. The sleeve 24 has an inner surface 25 and surrounds the annular outer surface 21 of each piston 20. The annular outer surface 21 of the piston 20 and the inner surface 25 of the sleeve 24 define a clearance 37. The size of the clearance 37 varies with temperature change within the pump 1. The clearance 37 is small when the temperature within the pump 1 is high, and the clearance 37 is large when the temperature within the pump 1 is low. The clearance 37 is in fluid communication with the low pressure area 35 and the pumping chamber 34. The pumping chamber 34 of each piston 20 defines the internal passage 42 extending between a pressure face end 43 of the piston 20 and its annular outer surface 21. The sleeve 24 is movable between a first and second position by the electro-hydraulic unit 32. The height of the individual sleeve 24 is preferably about equal to the fixed reciprocation distance 45 of the piston 20. Thus, when sleeve 24 is in its first position as illustrated in FIG. 2*a,* the spill ports 30 are blocked from fluid communication with the low pressure area 35 and virtually all of the fluid displaced by the piston 20 is pushed into the high pressure area 28. When sleeve 24 is in its second position as illustrated in FIG. 2*b,* the spill ports 30 are in fluid communication with the low pressure area 35 and virtually all of the fluid displace by the piston 20 is spilled back into the low pressure area 35 within pump 1. In order to achieve desired pressure within the common rail, the electro-hydraulic control unit 32 may move the sleeve 24 to any position between the first position, in which there is maximum output of pressurized hydraulic fluid, and the second position, in which there is virtually no output of pressurized hydraulic fluid. The sleeve 24 is biased to its first position. It should be appreciated that the present invention could be applied to a pump in which the sleeves 24 are biased to their second position and virtually none of the actuation fluid is being compressed and delivered to the common rail via the high pressure outlets 29. When the sleeve 24 is in its first position, the pumping chamber 34 is substantially blocked from the low pressure area 35 because the only fluid communications are via the clearances 37 between the inner surfaces 25 of the sleeve 24 and barrel 19 and the outer surface 21 of the piston 20.

In order to vary the size of the clearance 37 to compensate for temperature change within the pump 1, the piston 20 and at least one of the sleeve 24 and the barrel 19 are comprised of dissimilar materials. The piston 20 is preferably comprised of steel, although it should be appreciated that the piston 20 could be comprised of another material, including a substantially homogeneous metallic alloy. In the preferred embodiment, the sleeve 24 is comprised of a material with a lower coefficient of thermal expansion than the metal, preferably steel, comprising the piston 20. The sleeve 24 is preferably composed of ceramic, which has a lower coefficient of thermal expansion than steel and has a high resistibility to wear cause by the particles in the hydraulic fluid and high pressure. The coefficient of thermal expansion of ceramic is approximately 80% of the coefficient of thermal expansion of steel. However, it should be appreciated that other materials having a lower coefficient than steel, or any other material comprising the piston, could also be used. Alternatively, the sleeve 24 and the piston 20 can be comprised of similar materials, while the barrel 19 and the piston 20 are comprised of dissimilar materials. The barrel 19 can be composed of a material with a lower coefficient of thermal expansion than the material comprising the piston 20. The piston 20 is preferably composed of processed steel, and the barrel 19 is preferably composed of ceramic. Again, the ceramic has a coefficient of thermal expansion which is approximately 80% of the coefficient of thermal expansion of the steel. Although the present invention uses ceramic because it has a lower coefficient of thermal expansion than steel of the piston 20 and a high resistance to wear, any suitable material with a lower coefficient than that material comprising the piston may be used.

Industrial Applicability

Referring to FIG. 1 and FIG. 2, when the hydraulic system is activated, hydraulic fluid flows via the inlet 8 of pump 1 to the low pressure area 35. The low pressure area 35 is in fluid communication with the clearance 37 defined by the inner surface 25 of the sleeve 24 and the annular outer surface 21 of the piston 20. The sleeve 24 will be in its first, or biased, position in which the spill ports 30 are covered. Virtually all the hydraulic fluid is being pressurized and delivered to the common rail of the hydraulic system. The electronic control module will communicate to the electro-hydraulic unit 32 that the pressure within the common rail must be increased in order to start the engine. The electro-hydraulic unit 32 will maintain the sleeve 24 via the connector 53 in its first position, at which the sleeve 24 covers the spill ports 30 and substantially blocks fluid communication between the spill ports 30 and the low pressure area 35. Only when the sleeve 24 is in the first position and the piston 20 is in its advanced position will pressure build within the piston 20 allowing the hydraulic fluid to be pressurized in the pumping chamber 34. The pressurized hydraulic fluid will be delivered to the high pressure area 28 past the outlet control valve 26. The high pressure hydraulic fluid will then be delivered to the common rail via the outlet passages 29.

However, when the temperature is low within the pump 1, such as in cold starts, the viscosity of the hydraulic fluid within the low pressure area 35 and the clearance 37 is greater than it is at warmer temperatures or after the engine has been running for a period of time. The high viscous hydraulic fluid at colder temperatures makes it more difficult for the electro-hydraulic unit 32 to move the sleeve 24 between its first and second position in order to vary the output of high pressure hydraulic fluid from the pump 1. Despite variations in temperature within the pump 1, the electro-hydraulic control unit 32 supplies a predetermined control force in order to move the sleeve 24 between its first and second positions. This can cause reduced pump delivery at warm temperatures at which the hydraulic fluid has a low viscosity and slow actuator response at cold temperatures at which the hydraulic fluid has a high viscosity. Both situations are undesirable. The present invention compensates for the temperature change within the pump 1 and the resulting viscosity changes in the hydraulic fluid by varying the size of the clearance 37.

According to the preferred embodiment of the present invention, the piston 20 is preferably comprised of metal, such as steel, and the sleeve 24 is preferable composed of ceramic. Because the ceramic of the sleeve 24 has a coefficient of thermal expansion that is about 80% of the coefficient of thermal expansion of the steel of the piston 20, the steel of the piston 20 will expand more than the ceramic of the sleeve 24 when the pump 1 temperature increases and contract more than the ceramic of the sleeve 24 when the pump 1 temperature decreases. The size of the clearance 37 will change with the temperature within the pump 1. Therefore, the piston 20 and its respective sleeve 24 can be fabricated such that clearance 37 between the inner surface 25 of the sleeve 24 and the annular outer surface 21 of the piston 20 is the appropriate size for hydraulic fluid to move the sleeves efficiently at low temperatures, yet limit leakage through the clearance 37 at high temperatures.

At cold temperatures, the steel of the piston 20 will contract more than the ceramic of the sleeve 24, causing the size of the clearance 37 between the annular outer surface 21 of the piston 20 and the inner surface 25 of the sleeve 24 to increase. Preferably, depending on the extent of the decrease in temperature within the pump 1, the diameter of the clearance 37 will be approximately 10–20 microns. When the pump 1 is activated at cold temperatures, the elector-hydraulic unit 32 will move the sleeve 24 from its second, position in which the sleeve 24 does not cover the spill ports 30, toward its first position, in which the sleeve 24 does cover the spill ports 30. Due to the increase in the size of the clearance 37 between the annular outer surface 21 of the piston 20 and the inner surface 25 of the sleeve 24, the elector-hydraulic unit 32 will be able to move the sleeve 24 through the high viscous hydraulic fluid without delay. The sleeve 24 will block fluid communication between the pumping chamber 34 and the low pressure area 35, causing pressure to build within the pumping chamber 34 and allowing the reciprocating piston 20 to pressurize the hydraulic fluid. The hydraulic fluid will then be delivered past the outlet control valve 26 to the high pressure area 28 and out the pump 1 via one of the high pressure outlets 29.

At warm temperatures, both the ceramic of the sleeve 24 and the steel of the piston 20 will expand, and the hydraulic fluid will become less viscous. Because the ceramic of the sleeve 24 has a coefficient of thermal expansion about 80% of the coefficient of thermal expansion of the steel of the piston 20, the ceramic of the sleeve 24 will expand less than the steel of the piston 20. Thus, as the temperature increases, the diameter of the annular outer surface 21 of the piston 20 will increase more than the diameter of the inner surface 25 of the sleeve 24, causing the size of the clearance 37 to decrease. Recalling that the size of the clearance 37 could be for example, as large as 20 microns at cold temperatures, the size of the clearance 37 preferably will be approximately, for one example, 8 microns at warm temperatures. Thus, the size of the clearance 37 may vary over 100% between cold and warm temperatures. When the pump 1 is activated and temperature within the pump 1 is high, the electro-hydraulic unit 32 will move the sleeve 24 from its second, biased position toward its first position in which the spill ports 30 are covered. Because the clearance 37 decreases as the temperature within the pump 1 increases, the decreased clearance 37 will compensate for the less viscous hydraulic fluid. The elector-hydraulic unit 32 will be able to move the positioning of the sleeve 24 with the least amount of leakage and the most efficiency. Because the pumping chamber 34 will be blocked from fluid communication with the low pressure area 35, pressure will build within the pumping chamber 34 and the reciprocating piston 20 will efficiently pressurize the hydraulic fluid. The pressurized hydraulic fluid will be delivered to the common rail via the high pressure outlets 29.

As the engine continues operating, the desired pressure within the common rail will be varied depending on speed and load. At high speeds and loads, the pressure within the common rail is generally desired to be significantly higher than the desired pressure when the engine is idling. Therefore, the electronic control module will continue to communicate to the electro-hydraulic unit 32 to change the positioning of the sleeves 24 in order to achieve the varying desired rail pressure. Further, as the engine continues working, the hydraulic fluid will continue to warm and become less vicious, and the clearance 37 between the piston 20 and the sleeve 24 will decrease due to the thermal expansion difference between the ceramic of the sleeve 24 and the steel of the piston 20. The continued movement of the sleeves 24 between the first and second positions will be enhanced by the decreased clearance 37.

Alternatively, or in addition, the temperature change within the pump 1 can be compensated for by comprising the piston 20 and the barrel 19 of dissimilar materials. The piston 20 is positioned within the piston bore 14 of the barrel 19 and is adjacent to the barrel 19. Thus, by comprising the barrel 19 of a material with a lower coefficient of thermal expansion than the material comprising the piston 20, the piston 20 will expand more than the barrel 19 at warm temperatures causing a decrease in the clearance between the piston 20 and barrel 19, and the piston 20 will contract more than the barrel 19 at cold temperatures causing an increase in the clearance 37 making pump operation easier at low temperatures, yet reducing inefficiency from leakage at high temperatures. The piston 20 is preferably comprised of steel. The barrel 19 is preferably comprised of ceramic, although it is appreciated that the barrel 19 could be comprised of any material that has a lower coefficient of thermal expansion than steel. Further, it should be appreciated, that the barrel 19, alone, could be comprised of ceramic, or the barrel assembly 18, including the barrel 19 and the pressure sealing collar 16, could be comprised of ceramic. Thus, as the temperature within the pump 1 increases and the viscosity of the hydraulic fluid decreases, the clearance 37 will decrease allowing more volumetric efficiency. As the temperature within the pump 1 decreases and the viscosity of the hydraulic fluid increases, the clearance 37 will increase allowing a faster actuator response time and easier pumping action.

Overall, the present invention is advantageous because it reduces the need to compromise exceptional performance at any pump 1 temperature in order to have acceptable performance at high and low pump temperatures. By comprising at least one of the sleeve 24 and the barrel 19 of a material with a lower coefficient of thermal expansion than the material comprising the piston 20, the size of the clearance 37 varies with the temperature change within the pump 1 and the viscosity change within the hydraulic fluid. At high temperatures, the clearance 37 decreases to reduce high viscosity hydraulic fluid flow thorough the clearance 37 without reducing the speed at which the electro-hydraulic unit 32 moves the sleeve 24 between the first and second position. At low temperatures at which the viscosity of the hydraulic fluid is high, the clearance 37 increases to allow the electro-hydraulic unit 32 to move the sleeve 24 between its first and second position with the greatest efficiency while maintaining only a small amount of leakage. Further, the present invention is advantageous because it compensates for the temperature change within the pump 1 and the viscosity change within the hydraulic fluid without changing the design of the pump 1. Rather, at least one of the sleeve 24 and the barrel 19 is comprised of a material with a lower coefficient of thermal expansion than the material comprising the piston 20. Preferably, at least one of the sleeve 24 and the barrel 19 is comprised of ceramic.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A pump comprising:

a pump housing defining an inlet and an outlet;

a barrel at least partially positioned in the housing;

at least one piston that reciprocates in the pump housing and is positioned at least partially in the barrel;

a sleeve surrounding an annular outer surface of each piston and being movable; and the sleeve being comprised of a material with a lower coefficient of thermal expansion than a material comprising the piston.

2. The pump of claim 1 wherein a clearance between the annular outer surface of the piston and the inner surface of the sleeve is small when the temperature within the pump is high; and the clearance between the annular outer surface of the piston and the inner surface of the sleeve is large when the temperature within the pump is low.

3. The pump of claim 2 wherein the sleeve is comprised of ceramic.

4. The pump of claim 3 wherein the piston is comprised of steel.

5. The pump of claim 2 wherein the barrel is comprised of a material with a smaller coefficient of thermal expansion than the material comprising the piston.

6. The pump of claim 5 wherein the barrel is comprised of ceramic.

7. The pump of claim 6 wherein the piston is comprised of steel.

8. The pump of claim 2 wherein the clearance being a fluid connection between a low pressure area and a pumping chamber.

9. The pump of claim 8 wherein the pumping chamber includes the piston defining an internal passage extending between a pressure face end and a side surface; and the sleeve being movable between a first position in which the internal passage is substantially blocked from fluid communication with the low pressure area, and a second position in which the internal passage is in fluid communication with the low pressure area.

10. The pump of claim 9 wherein the sleeve is movable between the first position and the second position by an actuator.

11. The pump of claim 10 wherein the sleeve is biased to the first position.

12. The pump of claim 11 wherein the sleeve is comprised of ceramic; and the piston is comprised of steel.

13. The pump of claim 11 wherein the barrel is comprised of ceramic; and the piston is comprised of steel.

14. A method of compensating for temperature change within a pump comprising the steps of:

increasing a clearance between an annular outer surface of a piston and at least one of an inner surface of a sleeve and a barrel when a temperature within the pump is low; and decreasing the clearance between the annular outer surface of the piston and at least one of an inner surface of the sleeve and the barrel when the temperature within the pump is high.

15. The method of claim 14 wherein the increasing and decreasing steps include a step of utilizing a sleeve and a piston made from materials having different coefficients of thermal expansion.

16. A sleeve metered pump comprising:

a pump housing defining an inlet and an outlet;

a barrel at least partially positioned in the housing;

at least one piston that reciprocates in the pump housing and is positioned at least partially in the barrel;

a sleeve surrounding each piston at a position between opposite ends of the piston, and being movable with respect to the barrel; and said sleeve being comprised of a material with a lower coefficient of thermal expansion than a material comprising the piston.

17. The pump of claim 16 wherein the sleeve is comprised of ceramic.

18. The pump of claim 17 wherein the piston defines an internal passage extending between a pressure face end and a side surface; and the sleeve being movable between a first position in which the internal passage is substantially blocked from fluid communication with a low pressure area, and a second position in which the internal passage is in fluid communication with the low pressure area.

19. The pump of claim 18 wherein the sleeve is movable between the first position and the second position by an actuator.

* * * * *